United States Patent [19]

Jacobson et al.

[11] 4,318,512

[45] Mar. 9, 1982

[54] QUICK ACTION SCREEN LATCHING APPARATUS FOR HAMMERMILL

[75] Inventors: Howard C. Jacobson, St. Paul; George R. Olson, Minnetonka, both of Minn.

[73] Assignee: Jacobson Machine Works, Inc., Minneapolis, Minn.

[21] Appl. No.: 955,132

[22] Filed: Oct. 26, 1978

[51] Int. Cl.[3] ..... B02C 13/04

[52] U.S. Cl. ..... 241/73; 241/185 R; 241/285 A; 241/89; 269/228

[58] Field of Search ..... 241/73, 185 R, 285 A, 241/285 R, 89, 89.1–89.3; 292/263, DIG. 49; 269/228

[56] References Cited

U.S. PATENT DOCUMENTS

| | | | |
|---|---|---|---|
| 2,669,396 | 2/1954 | Nickle | 241/89 |
| 3,196,915 | 7/1965 | Bryant | 241/89 X |
| 3,510,072 | 5/1970 | Jacobson et al. | 241/73 |
| 3,730,116 | 5/1973 | Schramayr | 269/228 X |
| 3,904,134 | 9/1975 | Olson | 241/73 |

*Primary Examiner*—Richard B. Lazarus
*Assistant Examiner*—Kenneth J. Ramsey
*Attorney, Agent, or Firm*—Leo Gregory

[57] ABSTRACT

The invention herein relates to the screen latching apparatus of a hammermill structure in which the improvement consists of a releasing and latching arrangement for the removal and replacement of a screen member by a tension linkage whereby the screen is released for removal from its operating position and the replacement screen is latched into position by the forward and reverse action of an operating handle.

3 Claims, 4 Drawing Figures

QUICK ACTION SCREEN LATCHING APPARATUS FOR HAMMERMILL

BACKGROUND OF THE INVENTION

1. Field of the Invention

This invention relates to a hammermill screen releasing and latching apparatus.

2. Description of the Prior Art

It is a common practice to use threaded members such as bolts requiring generally the use of tools for the change of a screen member and also hand wheels are in use which require considerable rotation.

SUMMARY OF THE INVENTION

This invention relates to an improvement in the structure for releasing and latching hammermill screens for their removal and replacement by the action of a single operating handle with related tension link members and wherein the screen itself is carried in a carriage frame member which overlies a support and said screen is engaged and secured by tension applied to said carriage frame member by linkage and is latched in such position by the single action of an operating handle.

It is an object of this invention to provide a readily operated apparatus for the quick release and removal of a hammermill screen for the replacement thereof.

It is another object of this invention to provide a support member for a hammermill screen within the housing of the hammermill, a carriage frame member having said screen therein overlying said support member and an operating handle through a tension linkage engaging said carriage frame member and securing the same onto said support member by the single action of said operating handle.

It is more specifically an object of this invention to provide a hammermill screen latching apparatus comprising in connection with a screen support and a screen carriage frame member having said hammermill screen therebetween, a pair of hook members carried by said screen carriage frame, a rod engaging said hook members, a pair of transversely spaced tension members engaging said rod and an operating rod linked to said tension members by a handle operating said rod, securing and releasing said screen member by a forward and reverse motion thereof.

DESCRIPTION OF THE DRAWINGS

FIG. 1 is a view in front elevation;

DESCRIPTION OF PREFERRED EMBODIMENT

Figure 3:
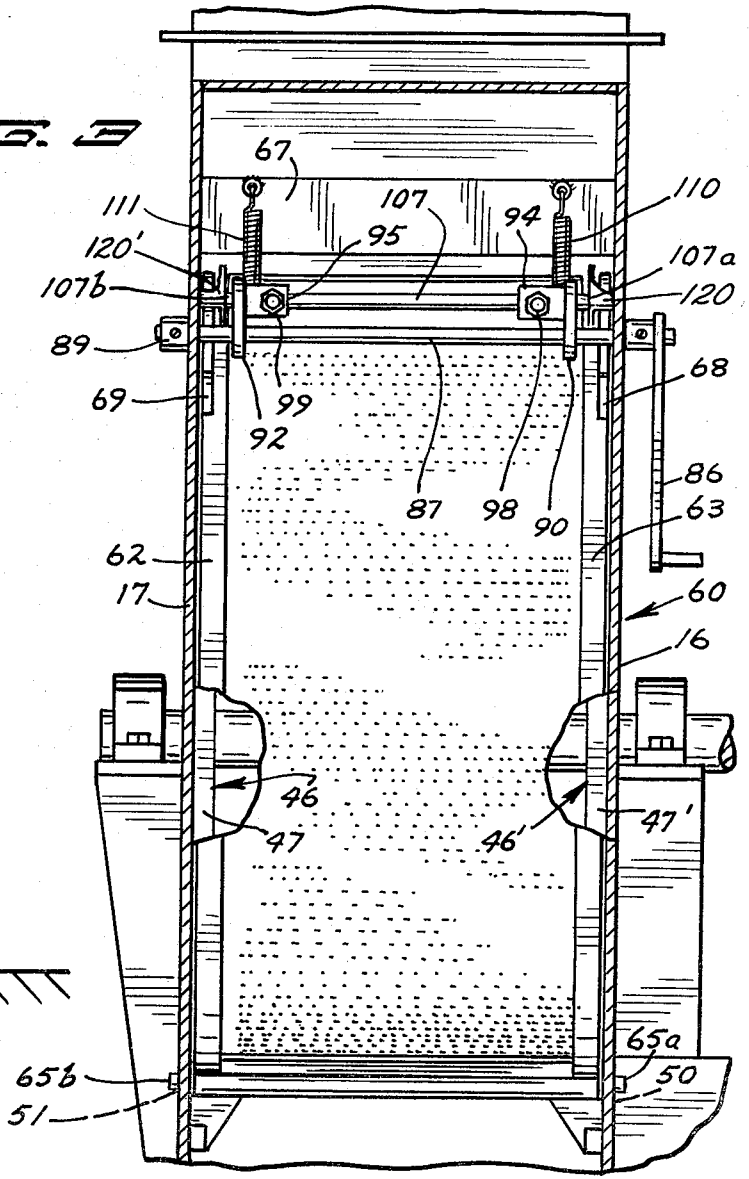
FIG. 3 is a view in vertical section taken on line 3—3 of FIG. 2 as indicated and showing a view as if seen in front elevation.

Referring to the drawings, a hammermill structure generally is indicated by the reference numeral 10.

Only as much of said general structure will be described as is believed necessary for the disclosure and adequate description of the portion thereof comprising the invention hrerein.

The invention herein has to do particularly with a quick action releasing and latching apparatus in connection with the screen of said hammermill.

Said hammermill comprises a housing 11 having front and rear walls 13 and 14, said walls 16 and 17, front and rear angled upper wall portions 20 and 21 terminating in a top wall 23. Said top wall has extending therethrough an incoming feed chute 27 having depending front and rear wall portions 30 and 31 leading into a grinding chamber 32.

Mounted on said front wall are upper and lower doors 34 and 35 carried by hinges 36 and 37. Like doors 38 and 39 are carried on the rear wall 14. Operating said hammermill is a motor 40 driving a shaft 41 extending into said housing through the side wall 16 and mounted onto said shaft within the grinding chamber 32 are a plurality of rotors 42 carrying thereon in a conventional manner hammers 43.

Figure 2:
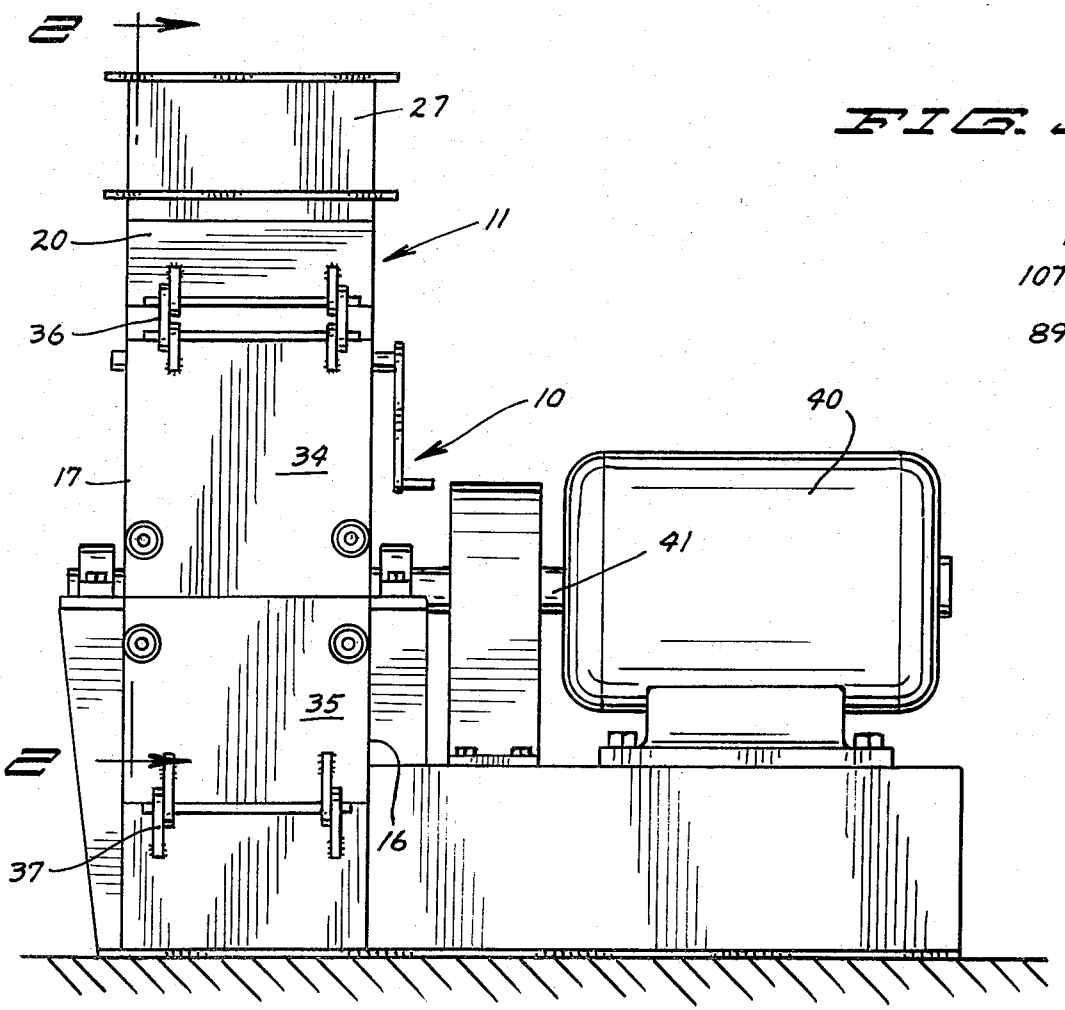
FIG. 2 is a view in vertical section on an enlarged scale taken on line 2—2 of FIG. 1 as indicated showing two different operating positions of the latching apparatus at the front and rear of the left side thereof.
Figure 2:
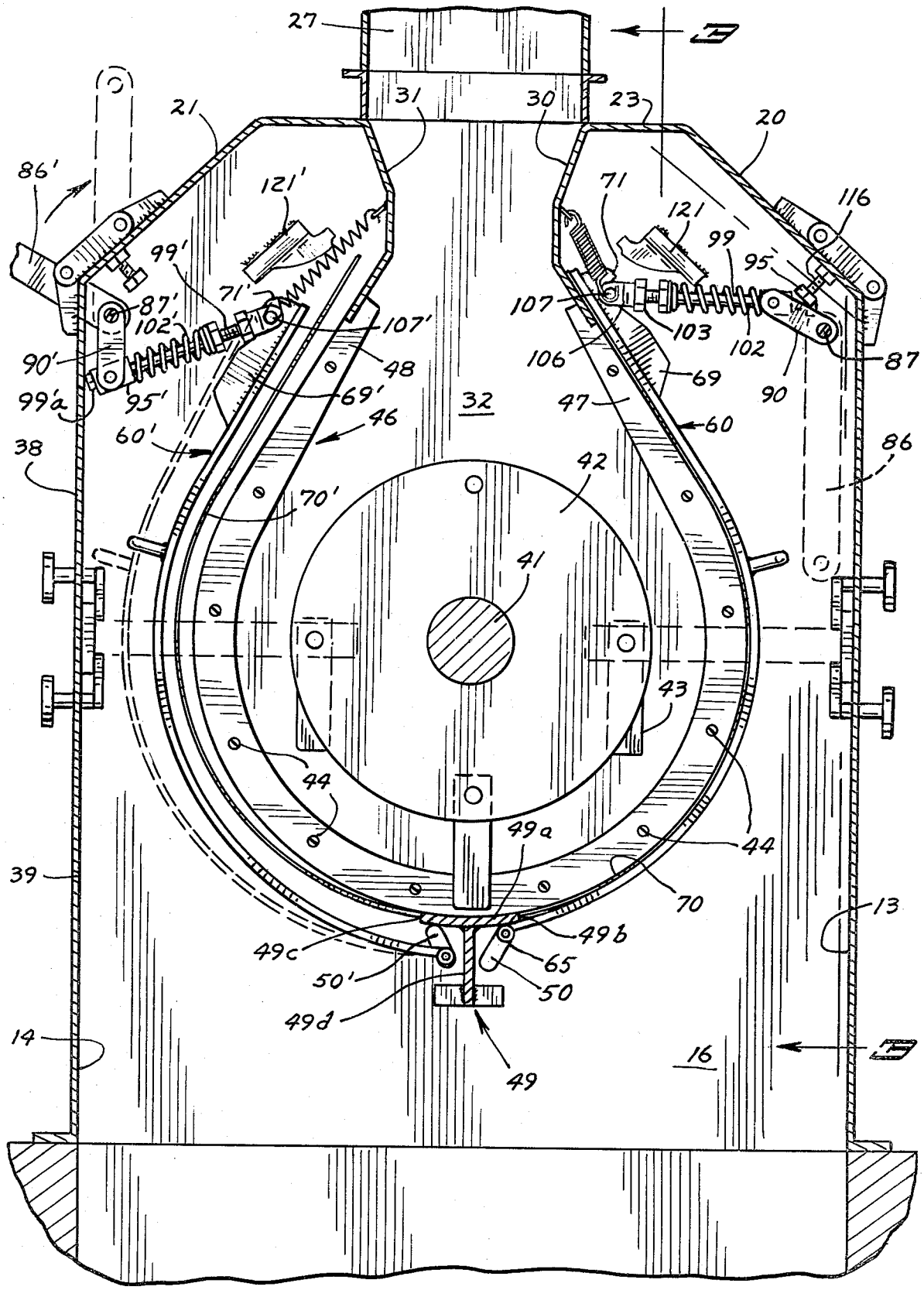

Referring to FIGS. 2 and 3, carried on the side walls 16 and 17 and secured thereto as by bolts 44 are screen supporting plate or ring members 46 and 46' of which the member 46 is seen as viewed from line 2—2 of FIG. 1 and like portions of 46' to which reference may be made will be indicated by like reference numerals with a prime added.

Said member 46 is shown in plan in the form of an inverted yoke shaped member having like opposed portions 47 and 48 terminating upwardly by engagement with the adjacent portions of the depending walls 30 and 31. Underlying said ring members and extending across said housing secured as by bolting is a support member 49 in the form of a T-bar. Formed along the opposed side edges of the upper plate **49*a* of said T-bar are edge portions 49*b* and 49*c*** to be engaged by the lower edges of screens as will be described.

Overlying the screen supporting meembers 46 and 46' are screen carriage frame members 60 and 60' of which the member 60 will be described with particular reference to FIG. 3 and corresponding portions of the member 60' will be indicated by like reference numerals with a prime added.

Said frame member 60 is substantially rectangular in plan having side rail members 62 and 63 connected at their bottom portions by a cross rod 65 having end portions **65*a* and 65*b* pivoted in and extended through elongated slots 50 and 51 in the side walls 16 and 17 adjacent each side of the web 49*d* of said T-bar 49**.

Extending across the upper end portions of said rail members 62 and 63 is a plate member 67. Said carriage frame member is curved in longitudinal section to correspond to the curvature of the supporting members which it overlies. For clarification, the frame member 60 as seen in FIG. 3 overlies the supporting ring member 47 and 49.

Figure 4:
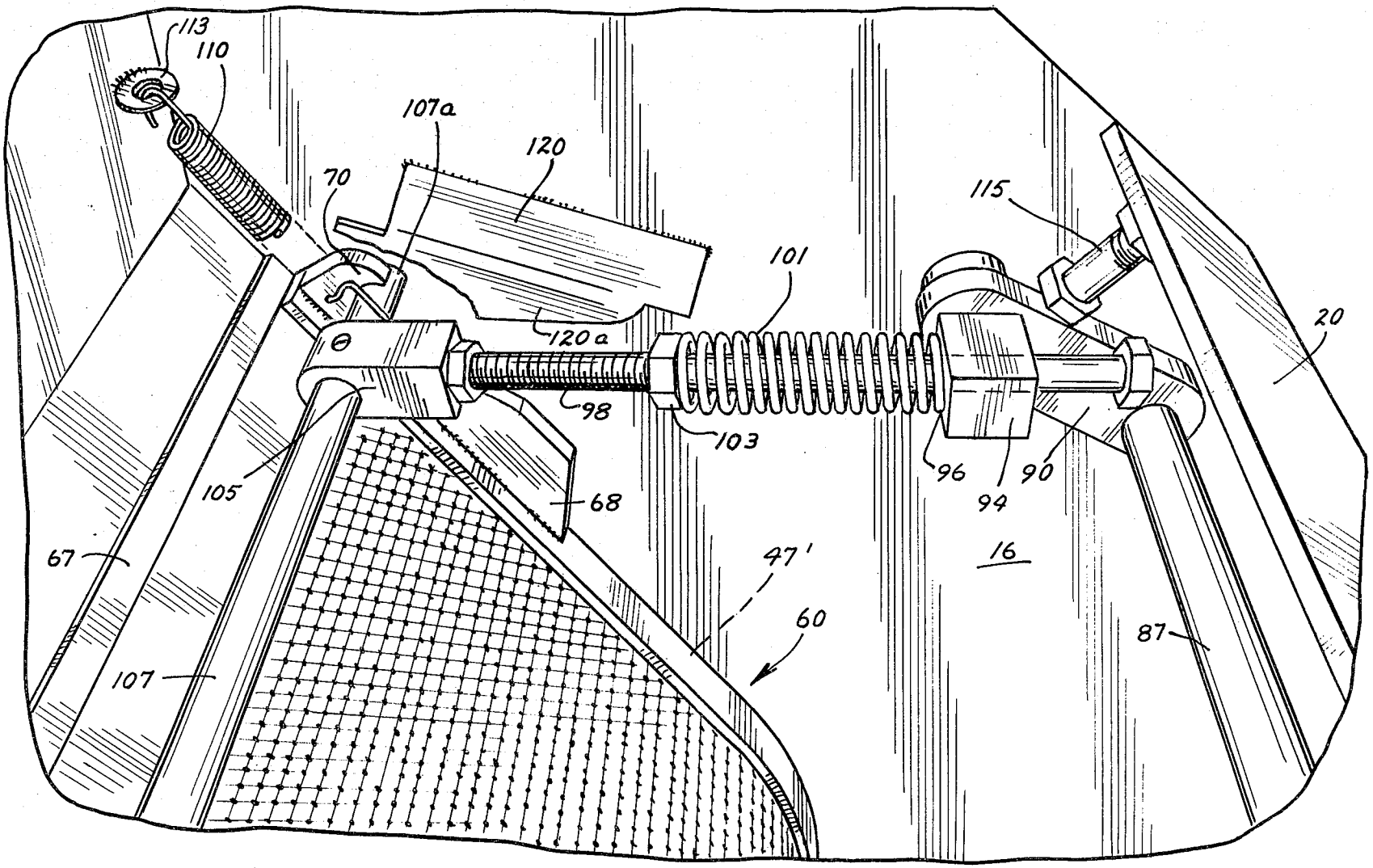
FIG. 4 is an enlarged fragmentary view in perspective showing in detail the latching structure corresponding to the right side portion of FIG. 3 and in a transverse opposed relation to the right side portion of FIG. 2.

It is noted here that the view in FIG. 4 represents in perspective the portion of the frame member 60 which is adjacent the side wall 16, overlying the supporting ring portion 47'.

At the upper end portions of the side rail members 62 and 63 are upstanding rail guide members 68 and 69 having formed therein as here shown hook members 70 and 71.

Disposed over said ring supporting portions 47 and 47' and underlying said screen carriage member 60 is a screen member 70 which at its lower end is resting against the edge **49*b* of the plate 49*a*. A screen 70' is similarly situated in opposed relation to said screen 70 as indicated in FIG. 2**.

The latching apparatus for said carriage frame members 60 and 60' is identical and latching apparatus 85 in connection with the carriage frame member 60 will be described in detail. The corresponding portions of the latching apparatus 85' for the framemember 60' will be indicated by like reference numerals with a prime added.

Said latching apparatus 85 comprises an operating handle or control lever 86 exterior of the housing and the same has rigid therewith an operating or lever rod 87 rotated thereby and extending through the side walls 16 and 17 of the housing and being secured outwardly of the side wall 17 by an appropriate locking means 89 such as indicated.

Said rod carries adjacent each end thereof at the inner sides of said side walls 16 and 17, a pair of tennsion arm link members 90 and 92 rigid therewith which form tension members for latching purposes and are locked in an over center position. Pivotally carried by said link members 90 and 92 are tension adapter link members 94 and 95 and these are here shown as being cube like in form having bores therethrough as indicated at 96.

Extending through said tension adapter members 94 and 95 are linking rod members 98 and 99. Said linking rod members are shown here as in the form of conventional headed and threaded bolts and have slidable axial movement relative to said members 94 and 95.

Carried on said linking rod members 98 and 99 are coiled springs 101 and 102. A nut 103 is threaded onto the forward threaded end of each of said rod members forcing a stop member to confine said spring and for adjustment of the tension thereof.

Said rod members 98 and 99 are here shown threaded into block members 105 and 106. Connecting said block members is a rod member 107 having its ends **107*a* and 107*b* extending therethrough to engage the carriage frame hook members 70 and 71 as first shown in FIG. 4**.

A pair of coil springs 110 and 111 in spaced relation are secured at one end thereof to said rod 107 and are secured at their other ends by appropriate means to the wall member 30 such as indicated at 113 in FIG. 4.

Extending inward of said angled wall 20 in alignment with said link members 90 and 91 are bolt like adjustable stop members 115 and 116. Said stop members are engaged by the link members 90 and 92 in an over center latching position.

Carried by said side walls 16 and 17 in operating relationship to said projecting rail portions 68 and 69 are a pair of relatively short channel screen carriage frame guide members 120 and 121 each having a depending wall portion as indicated at **120*a***.

OPERATION

FIG. 2 indicates in side elevation the latching apparatus in latched position as viewed at the right thereof with respect to the front portion of the hammermill shown and at the left thereof is indicated the apparatus in an unlatched position with respect to the rear portion of the hammermill.

For the removal of the screen 70' the operating handle 86' is shown having been moved from a downward latching position as indicated in FIG. 3 at 86 to an upwardly angled position as indicated at 86' in which position the link member 95 by rotation of the rod 87' is moved from an overcenter latching position such as is indicated by said link 91 to an unlatching or releasing position as indicated by said link 91'. Said link 91' draws the tension adapter member 95' in the direction of the head 99' of said rod member 99' releasing tension from the spring 102' and drawing the rod member 107' and the carriage frame member 60' away from the underlying supporting ring members.

Said operating handle 86' is shown vertically in dotted line at its maximum or full unlatching position in which position said rod 107' is pulled away from its hook connection with the carriage frame work and said frame member will swing outwardly of the door openings whereby the screen member 70' is very readily pulled out of said carriage frame member and replaced. The replacement screen will have its lower edge engage the edge portion **49*c* or 49*b***, as the case may be.

To latch the carriage frame member and the screen disposed therein, the carriage frame member is swung inwardly and with reference to FIGS. 2 and 4, the rod 107 will engage the hook members 70 and 71, the operating handle will be swung downwardly, the tension adapter members 94 and 95 will ride up the extension rods 98 and 99 bearing against and increasing the tension of the springs 101 and 102. As the carriage frame member 60 is swung inwardly and upwardly the projecting rail guide members 68 and 69 will move up into and through the guide members 120 and 121. Continued downward movement of the handle 86 moves the link members 90 and 91 to an overcenter latching or clamping position as indicated and the carriage frame member 60 and its underlying screen member 70 are securely latched under tension of the springs 101 and 102.

It is seen that the tension of the springs 101 and 102 is readily adjusted by rotation of their respective nuts 103.

As the carriage frame is moved to latching position, it rides upwardly in the slots 50 and 51 to securely engage the underlying screen member.

The FIG. 2 is showing a latched and unlatched position as viewed from the front and rear of the hammermill provides a convenient showing for description of the two positions.

The structure as described represents a very significant improvement and has proved to be very successful.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A hammermill comprising a housing having a rotor with hammers thereon within the grinding chamber of said housing in which the improvement consists of a quick action screen latching apparatus, having in combination a screen support means carried by said housing adjacent to said grinding chamber, a screen carriage member carrying a screen, said carriage member having a bottom cross member and a pair of side rail members with each having at their respective upper portions a pair of upwardly projecting rail guide members, each of said rail guide members having a hook portion, means pivotally supporting said carriage means to said housing, an operating handle member, an operating rod integral with said handle member extending transversely of said housing, a pair of spaced tension link members adjacentto the inner side of each side wall of said housing being rigid with and carried by said operating rod, a pair of tension rod members, an adapter link carried by each of said tension link members respectively having said tension rod members slidably disposed therethrough, a coil spring carried on each of said tension rod members, each spring respectively abutting said adapter links at one end thereof, a stop member carried on each end of said tension rod members engaging the other end of each coil spring, a transverse member extending across said tension rod members, said transverse member engaging said hook portions, a screen carriage guide member carried by each side wall of said housing respectively receiving said rail guide members having the same pass therethrough, and spring means carried by said housing retaining said transverse member in suspended position.

2. The structure set forth in claim 1, including stop means carried by said housing engaging said tension link members.

3. A hammermill comprising a housing having a rotor with hammers thereon within the grinding chamber of said housing in which the improvement consists of a quick action screen latching apparatus, having in combination a screen supporting means carried by said housing adjacent to said grinding chamber, a carriage frame member swingably supported by said housing, a rail forming each side of said member, an upstanding guide member on each of said rails, a hook member carried by each of said guide members, a cross rod removably engaging said hook members, a pair of spaced linking rod members pivoted to said cross rod, compressible means carried on each of said linking rod members, a tension adapter member carried on each of said tension rod members and being slidable thereon engaging said compressible means thereon, a tension arm link member pivoted to each of said tension adapter members, a cross rod carried by said tension arm link members, and an operating handle rigid with said cross rod whereby said operating handle pivots said tension arm link members and moves said tension adapter members to compress said compressible means and applying tension to said first mentioned cross rod engaging and holding said carriage frame in a position overlying said screen supporting means securing said screen therebetween.

* * * * *